US005110138A

United States Patent [19]

Vandermeide

[11] Patent Number: 5,110,138

[45] Date of Patent: May 5, 1992

[54] TOY SHOOTING GALLERY

[76] Inventor: Benjamin Vandermeide, 3904 Hallmark Dr., West Valley City, Utah 84119

[21] Appl. No.: 633,227

[22] Filed: Dec. 20, 1990

[51] Int. Cl.[5] ..... F41J 7/04

[52] U.S. Cl. ..... 273/391

[58] Field of Search ..... 273/391, 378, 386, 390, 273/392

[56] References Cited

U.S. PATENT DOCUMENTS

| | | | |
|---|---|---|---|
| 1,267,722 | 5/1918 | Walter | 273/391 |
| 3,503,614 | 3/1970 | Suroff et al. | 273/368 |
| 3,637,210 | 1/1972 | Brantley | 273/55 R |
| 3,647,216 | 3/1972 | Breslow | 273/123 R |
| 4,040,624 | 8/1977 | Lee | 273/391 |
| 4,249,743 | 2/1981 | Lee | 273/391 |
| 4,397,468 | 8/1983 | D'Andrade et al. | 273/390 X |
| 4,588,194 | 5/1986 | Steidle et al. | 273/391 |
| 4,827,892 | 5/1989 | Vandermeide | 124/19 |

*Primary Examiner*—William H. Grieb
*Attorney, Agent, or Firm*—Trask, Britt & Rossa

[57] ABSTRACT

A shooting gallery amusement device having an elongate frame member, a plurality of targets mounted upstandingly on said frame member and a return mechanism associated with said targets to return them to an upstanding position on said elongate frame member subsequent to their having been knocked down is disclosed. The return mechanism includes a plurality of cables, each cable being secured on a first end to a respective target and thereafter passing through a respective aperture defined in the elongate frame. Each cable is connected on its second end to an elongate rod which is positioned beneath the frame and adapted to be displaced relative to the frame. Upon a user's displacement of the rod, the cables urge the targets to return to an upstanding position subsequent to their having been knocked down by a force applied thereto by a projectile impacting thereon.

20 Claims, 5 Drawing Sheets

TOY SHOOTING GALLERY

BACKGROUND OF THE INVENTION

1. Field

This invention relates to amusement devices of the form which may be used by a child or adult to measure his skill and accuracy in marksmanship. More particularly, this invention is directed to a shooting gallery which may be used with toy guns of various configurations.

2. Statement of the Art

Various amusement-type devices directed for developing marksmanship skills in either children or adults are known. These devices are often called shooting galleries. Conventional constructions of such devices typically provide for a target, of some configuration, adapted to be shot at by a device which hurls missiles, pellets, or other projectiles.

Representative of such a conventional shooting gallery is that described in U.S. Pat. No. 3,503,614 (Suroff). This device includes a target which is mechanically associated with a pedal-driven drive mechanism. The user is provided with a seating means spacedly removed from the target and a gun which is mounted in communication with a support stand which retains the seating means in place. Upon the movement of the foot pedals by the user, the target is displaced, thereby providing the user with a plurality of moving targets at which he may direct a pellet or other projectile.

Various other amusement-type devices are adapted to present a target for hand-launched projectiles. In U.S. Pat. No. 3,647,216, a target game, adapted for placement on a horizontal surface, is disclosed. The target provides a structure having upwardly curved sides which terminate in a central opening. The user may direct a ball or similar type projectile up the curved sides with the objective of positioning the ball within the opening defined at the center of the target.

Another shooting gallery is disclosed in U.S. Pat. No. 3,637,210.

Common to all of the above-disclosed devices is the provision of a target at which a user may direct a projectile using either his hands or, alternatively, a gun of some configuration. Preferred shooting galleries are adapted to provide some visual indication of the user having correctly hit the target. Not only is this important to confirm to the user that he has, in fact, correctly aimed and fired his projectile, but, furthermore, some displacement of the target responsive to its having been struck by the projectile lends an added element of enjoyment to the device. While many of the aforementioned referenced devices provide for some indication of the user having actually struck the target, the instant invention is directed to a device which provides a visually distinctive displacement of the target and a mechanically facilitated means of returning the displaced targets to their original target orientation.

SUMMARY OF THE INVENTION

A shooting gallery which provides one or more uprightly standing targets is disclosed. The targets are adapted to be knocked down upon the application of a force thereto. The shooting gallery furthermore includes a manually activated mechanism adapted to subsequently return any targets, which have been knocked down by the user, to their original upstanding position.

The shooting gallery includes a frame which defines at least one aperture therein, a target positioned uprightly atop the frame and proximate the aperture, a cable, having a first end mounted on the target, and a rod positioned below the frame. The cable is inserted through the aperture in the frame and is connected on its second end to the rod. The cable is dimensioned to have a sufficient length to permit the target to be knocked down from its upright position to a prone position. The rod is adapted to be displaced with respect to the frame thereby displacing the cable and, as a result, urging the target to return to its upright position atop the frame.

In preferred constructions, the rod is configured to be an elongate member whose longitudinal axis is positioned or aligned parallel with the longitudinal axis of the frame. The rod is adapted to be displaced preferably laterally of the frame in order to effect the return of the targets to their initial upstanding orientation.

The frame may include an elongate member having a plurality of apertures spacedly positioned along its length. The elongate member includes a pair of supports, each support being mounted proximate one of the ends of the elongate member and positioned to support that elongate member spacedly above an underlying surface thereby permitting the rod to be positioned below the elongate member and above the underlying surface.

The cable may be fabricated from either an elastic, resilient material, e.g. a rubber band, or alternatively, it may be fabricated from a substantially nonstretchable material such as a piece of string or cord.

Some constructions of the invention may include the provision of an upstanding wall mounted on the frame proximate the elongate member. This upstanding wall is adapted to function as a stop for the targets as they are being urged from their knocked-down position to their upright, target-presenting orientation. A second cable, which is secured to the rod and subsequently passed through an aperture defined in the upstanding wall, may be used as a handle in order to facilitate the displacement of the rod and its operation in returning the knocked-down targets to their upright positioning.

In some configurations, the frame of the shooting gallery may include an enclosure which is positioned about the elongate member. The enclosure is configured to receive and retain projectiles which have been projected at the targets. The enclosure may include an anchor means adapted to secure the frame and the enclosure against lateral displacement along an underlying support surface. In preferred constructions, this anchor means may be vertically displaceable to engage the edge of a table or other underlying support surface and thereby secure the shooting gallery against a lateral displacement upon the user's displacement of the second cable.

DETAILED DESCRIPTION OF THE INVENTION

Figure 1:
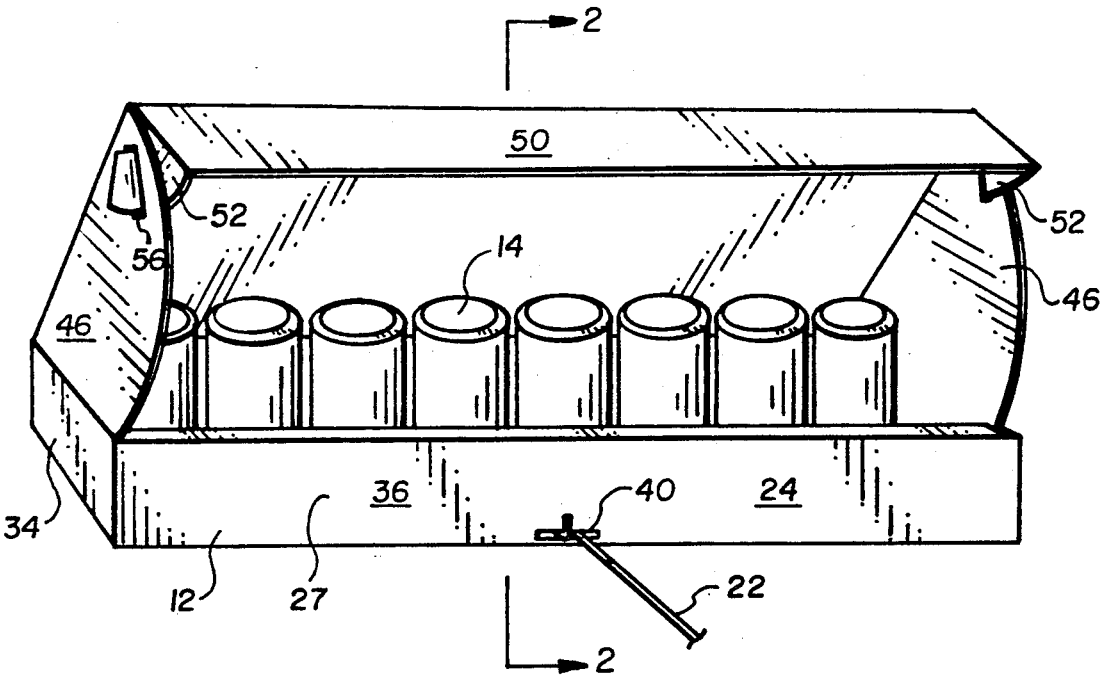
FIG. 1 is a perspective view of an embodiment of the shooting gallery of the invention.
Figure 2:
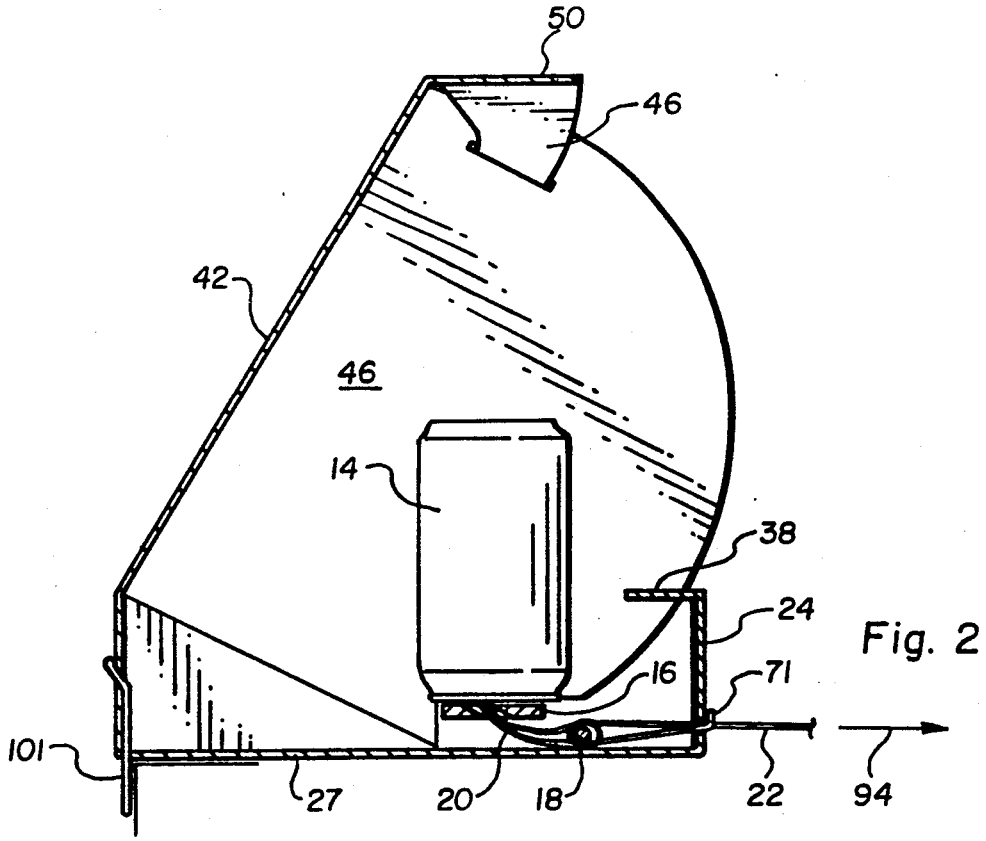
FIG. 2 is a cross-sectional view of the shooting gallery of FIG. 1 taken along section lines 2—2.

As shown in FIGS. 1 and 2, the invention includes an enclosure 12 which encloses a plurality of targets 14. The targets are positioned in an upright orientation atop an elongate support member 16 which is mounted within the enclosure 12. Each of the targets 14 is interconnected to a rod 18 by means of a respective cable 20. The rod is also connected to a second cable 22 which is directed through an aperture defined within the upstanding wall 24 of the enclosure. The cable 22 forms a handle which may be grasped by the user and displaced, thereby displacing the rod 18 and resultingly displacing the plurality of cables 20.

The Enclosure

Figure 6:
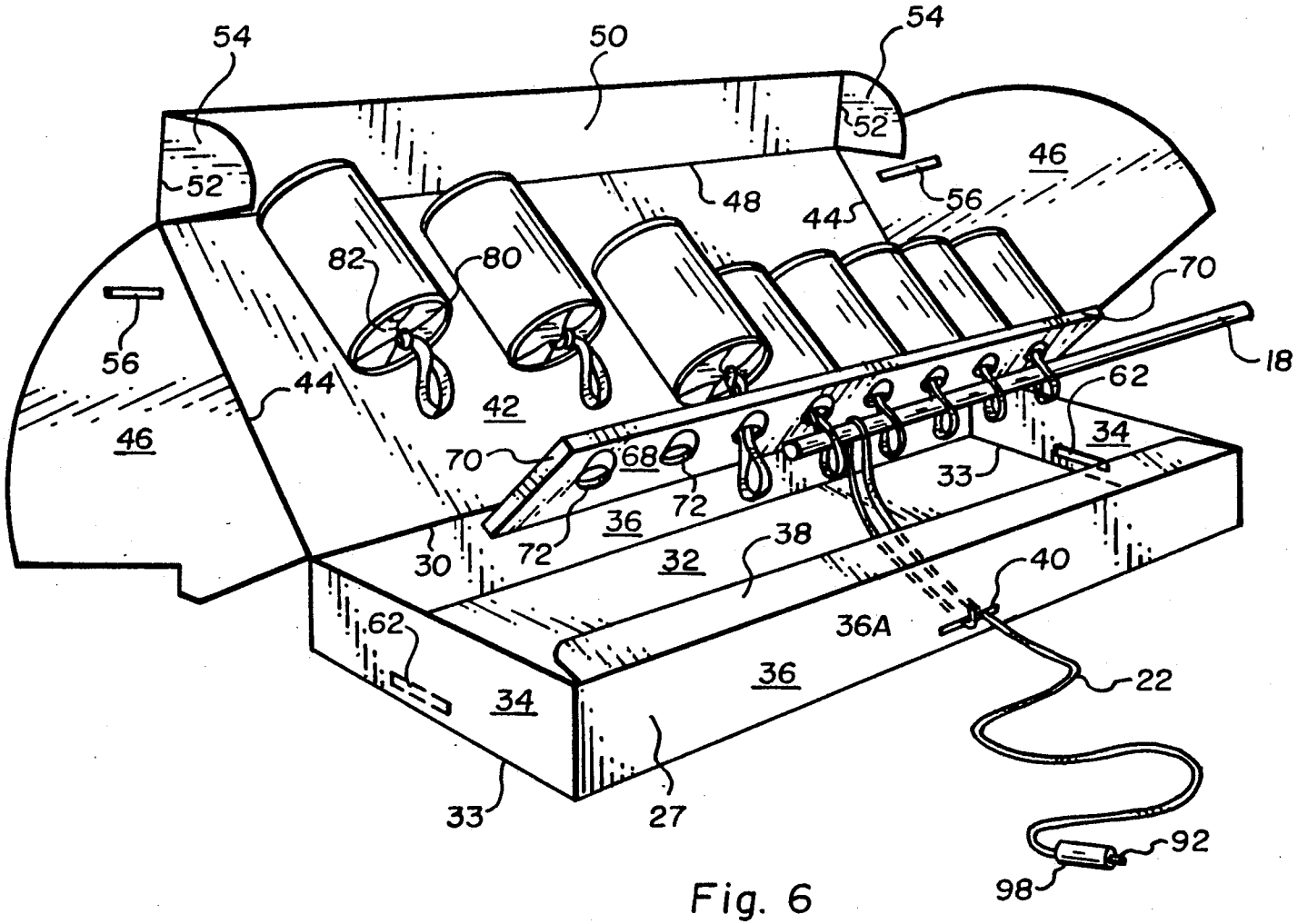
FIG. 6 is an exploded view of the shooting gallery illustrating the positioning of the targets on the elongate member and the placement of the rod and its connection to the various cables connecting the targets to the rod.

As shown to advantage in FIG. 6, the enclosure 12 includes a box-like member 27 and a lid 29 which is mounted thereto along an edge 30 of box member 27. The box-like member 27 includes a rectangularly configured planar bottom 32 and a plurality of upstanding sidewalls mounted about its perimeter. As shown, a pair of end sidewalls 34 are spacedly positioned parallel to one another about opposing sides of the bottom 32. A pair of sidewalls 36 are also positioned spacedly and parallel from one another about a second pair of opposing sides of the bottom 32. Each endwall 34 is connected to the pair of sidewalls 36 at the upstanding ends of the endwall 34.

The association of the two endwalls 34 and the two sidewalls 36 forms an upright, rectangularly configured, box-like member which is positioned upstandingly upon the bottom 32. Each of the sidewalls 34 and 36 is manufactured from a planar panel which is oriented uprightly. The front sidewall 36 forms the upstanding wall 24 of the enclosure. The front sidewall 36 may be fitted with a flap-like member 38 which extends laterally of the upstanding sidewall 36 and toward the interior of the box-like configuration 27 formed by endwalls 34 and sidewalls 36. As shown in FIG. 6, the upstanding wall 24 (front sidewall 36) defines an aperture 40 therein which extends through the complete thickness of the upstanding wall and provides a passageway for the cable 22.

The lid 29 is formed by a rectangularly configured planar panel 42 which is secured to the back sidewall 36 along edge 30. In preferred constructions, the back sidewall 36 and the top lid panel 42 may be formed of an integral member wherein the edge 30 is formed by a crease line bending of the integral member. Each of the opposing end edges 44 of lid panel 42 is fitted with a respective flap-like member 46 which, as shown in FIG. 2, adopts a configuration having a generally wing-shaped appearance. The flaps 46, in the assembled construction, provide a pair of spacedly mounted, parallelly oriented sidewalls which are adapted to form a retaining wall for projectiles which have been directed into the enclosure 12, as shown to advantage in FIG. 1.

The edge of the planar panel 42, which is spacedly positioned parallel to the edge 30 of the lid panel (identified hereafter as edge 48) is fitted with a flap-like extension 50 which is likewise a rectangularly configured planar panel member. The extension 50 may be formed as an integral member with the lid panel 42, the edge 48 being formed by a crease line. Mounted on the opposing edges 52 of the extension 50 are a pair of curved, wing-like extensions 54. The extensions 54 are each configured to be received and retained within a respective slot-like aperture 56 defined within extension 46. The interaction of the extensions 54 with their respective slot-like apertures 56 defined within sidewall flaps 46, is shown to advantage in FIGS. 1 and 2.

In preferred constructions, the sidewalls 34 of the box-like section 27 may be formed by a dual-wall construction. As shown to advantage in FIG. 9, the sidewalls 34 may be formed by a first upwardly extending endwall 59 which is bent and returned to form a second vertically extending sidewall 60. Sidewall 60 is positioned parallel to sidewall 59. Second sidewall 60 defines a slot-like aperture 62 therein which extends parallel to the edge 33 of the bottom panel 32. This slot-like aperture 62 is configured to receive and retain the elongate member 16 so as to position that elongate member spacedly above the bottom panel 32 of the box-like configuration 27.

The enclosure 12 may be fabricated from a number of materials. In preferred constructions, the enclosure 12 is fabricated from a sheet of reinforced paper or cardboard-type material and may be formed as an integral unit with the various sidewalls, flaps and extensions being defined by crease lines which have been placed into the integral sheet.

The Elongate Member

Figure 4:
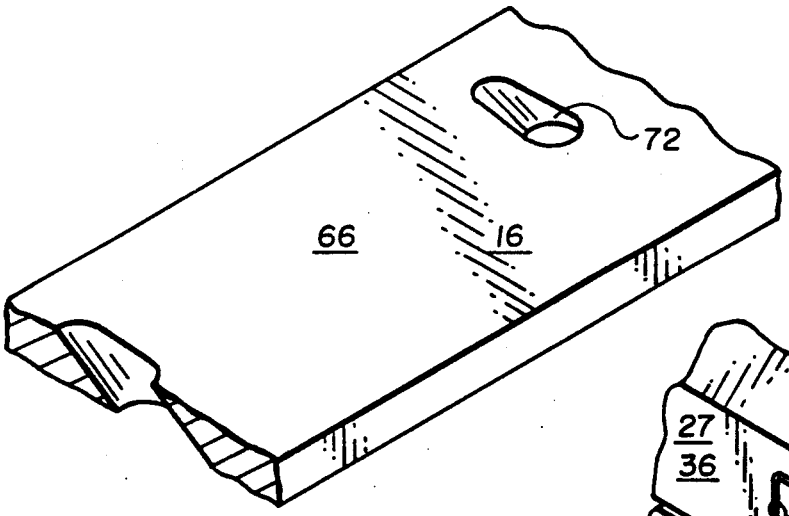
FIG. 4 is a sectional view of the elongate member of the shooting gallery.
Figure 9:
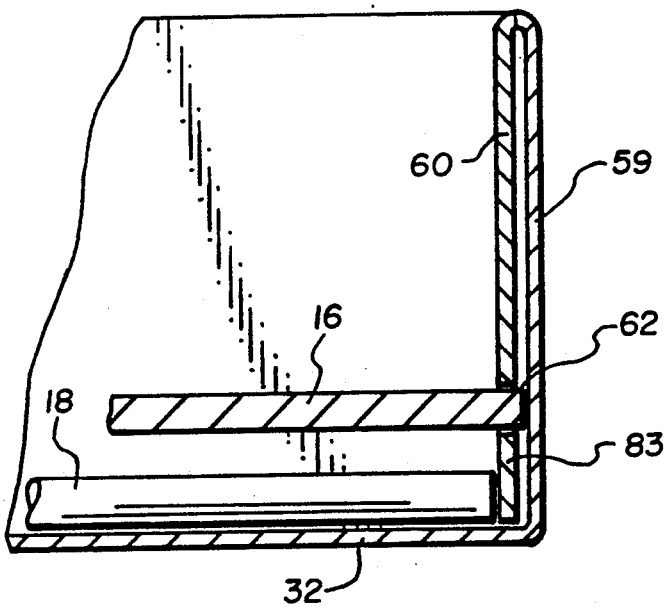
FIG. 9 is a front sectional view of the enclosure of the invention and its association with the elongate support member.

As shown to advantage in FIGS. 4 and 6, the elongate member 16 of the invention may be a generally rectangularly configured panel member having a planar upper surface 66 and a planar bottom surface 68. The elongate member includes a pair of spacedly positioned upright endwalls 70 which are configured to be received and retained in the slot apertures 62 of sidewall 34, preferably in the manner as shown in FIG. 9.

The elongate member 16 includes a plurality of apertures 72 which are spacedly positioned along a length of the elongate member 16. In preferred constructions, these apertures 72 define generally cylindrically shaped channels which are directed through the thickness of the elongate member 16. As shown to advantage in FIG. 8, these channels 72 each define a respective longitudinal axis 76. The longitudinal axes 76 of each of the respective apertures 72 are preferably oriented at an obtuse angle 78 to the lateral axis 80 of the elongate members 16, as shown to advantage in FIG. 8. This particular orientation of the channel 72 provides for ease in operation and facilitates the passage of the cables 20 through the apertures while minimizing any binding or obstruction to the displacement of those cables through their respective apertures 72. As shown to advantage in FIGS. 2, 3 and 9, the elongate member 16 is preferably oriented to be parallel to the bottom surface 32 of the box-like configuration 27. It may be observed that the lower portion 83 of the sidewall 60 forms a support for the elongate member 16 to retain that elongate member in this horizontal orientation above the underlying bottom surface 32.

In preferred constructions, the elongate member 16 is fabricated from a generally rigid material such as wood or reinforced cardboard. Alternatively, a plastic or other synthetic material may be used to fabricate the elongate member 16.

The Rod and Cable Assembly

Figure 8:
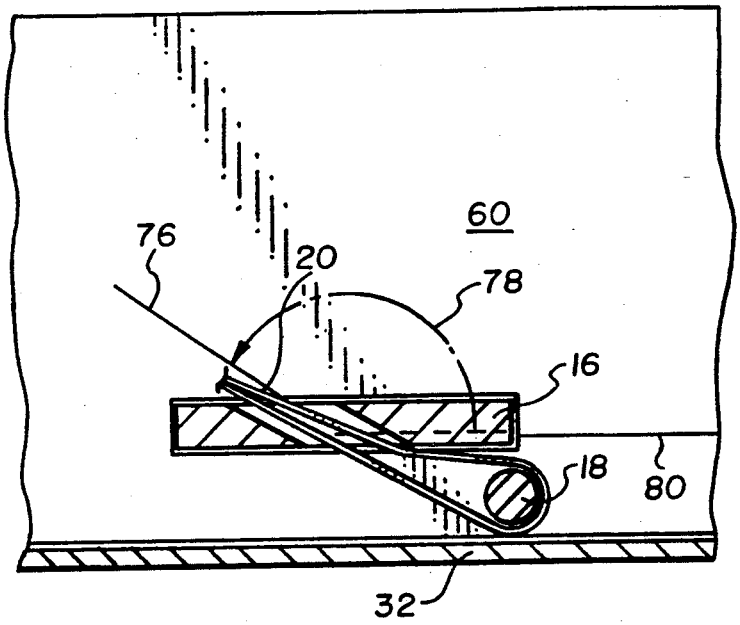
FIG. 8 is a cross-sectional view of the elongate support member of the invention illustrating the interassociation of the cable with the rod and the elongate member.

As shown to advantage in FIGS. 6 and 8, the rod 18 is a generally elongate, cylindrically shaped member which is dimensioned to extend substantially along the complete length of the elongate member 16. The diameter of the rod 18 is dimensioned such that the rod may be positioned below elongate member 16 and above the bottom surface 32 of the box-like configuration 27. Furthermore, the rod is positioned such that it may be slidably displaced between those two structural members, as shown to advantage in FIG. 8. In preferred constructions, the elongate rod 18 is fabricated from wood and may be a conventional dowel.

The rod 18 is connected to the various targets 14 by means of a plurality of cables 20, as shown to advantage in FIGS. 2 and 6. Each target 14 is fitted with a respective cable 20 on an end thereof. Each cable thereafter passes through a respective aperture 72 and is connected to the rod 18.

In the construction shown in FIG. 6, the cables 20 are shown as being conventional rubber bands which have been secured to the targets 14 by means of apertures 80 defined in the bottom surface 82 of each target 14. The rubber bands present a generally loop-like orientation which is passed through a respective aperture 72 and thereafter the rod 18 is inserted through the loop to form an interconnection of each cable 20 with the rod 18 (as shown to advantage in FIG. 6).

In other constructions, the cable 20 may be replaced by a conventional string or a cord which likewise may be secured to the targets 14 in a conventional manner, e.g. by looping the cable through a pair of apertures in the can's bottom. The cable is thereafter inserted through a respective aperture 72 and secured or tied to the rod 18 in a conventional manner.

The Targets

As shown in FIGS. 1, 2, 3 and 6, the targets 14 of the invention may be cylindrically shaped members In one construction, conventional soda cans, which have been emptied of their contents, have been used to form the target. These targets have been found very useful in that they present a fairly large, spatial target while having a relatively light weight which thereby permits the user to have a fairly large target to fire at while simultaneously having a target which may be knocked down by a fairly small force application. Understandably, other targets of various configurations could be substituted for the cylindrically shaped soda cans. The only prerequisite for the target is a fairly stable base member 86 which would permit the target to be positioned atop the elongate member 16 and retain its positioning on that elongate member with little or no additional support.

The Actuating Handle

As shown in FIG. 6, a second cable 22 may be secured to the elongate rod 18 to form a handle whereby the user may grasp the second cable 22, displace it and thereby also displace the elongate rod 18. As shown to advantage in FIG. 6, the cable 22 passes through the elongate slot 40 in the upstanding wall 24 and thereafter extends about the elongate rod 18 forming a loop thereabout. The cable thereafter returns to the elongate slot 40. The end of the cable 22 may be fitted with a hook or other fixture 71 which is to be adapted to engage against the outer surface of the upstanding wall 24 thereby retain the end of the cable in contact with the upstanding wall and thereby provide a fixed mounting whereby, upon the user displacing the opposing end 92 of cable 22, a force is applied to the elongate rod 18 to direct it in the direction shown by arrow 94 in FIG. 2.

The second cable 22 may be fitted with a retaining means 98 which is adapted to assist the user in loading a gun.

The instant invention may be utilized with toy guns of various configurations. For example, the toy gun disclosed and described in U.S. Pat. No. 4,827,892 (Van der Meide) is specifically adapted for use with the instant invention. The toy gun disclosed may be secured to the retraining means 98 and thereby form the means whereby the user can load rubber bands onto the toy gun while the gun is held in a substantially fixed orientation. In conventional constructions, this retraining means 98 may be a conventional, cylindrically shaped, wooden dowel which has been cut to define an elongate slot therein configured to slidably receive the cable 22 and be retained thereon.

Restraining Means

Figure 3:
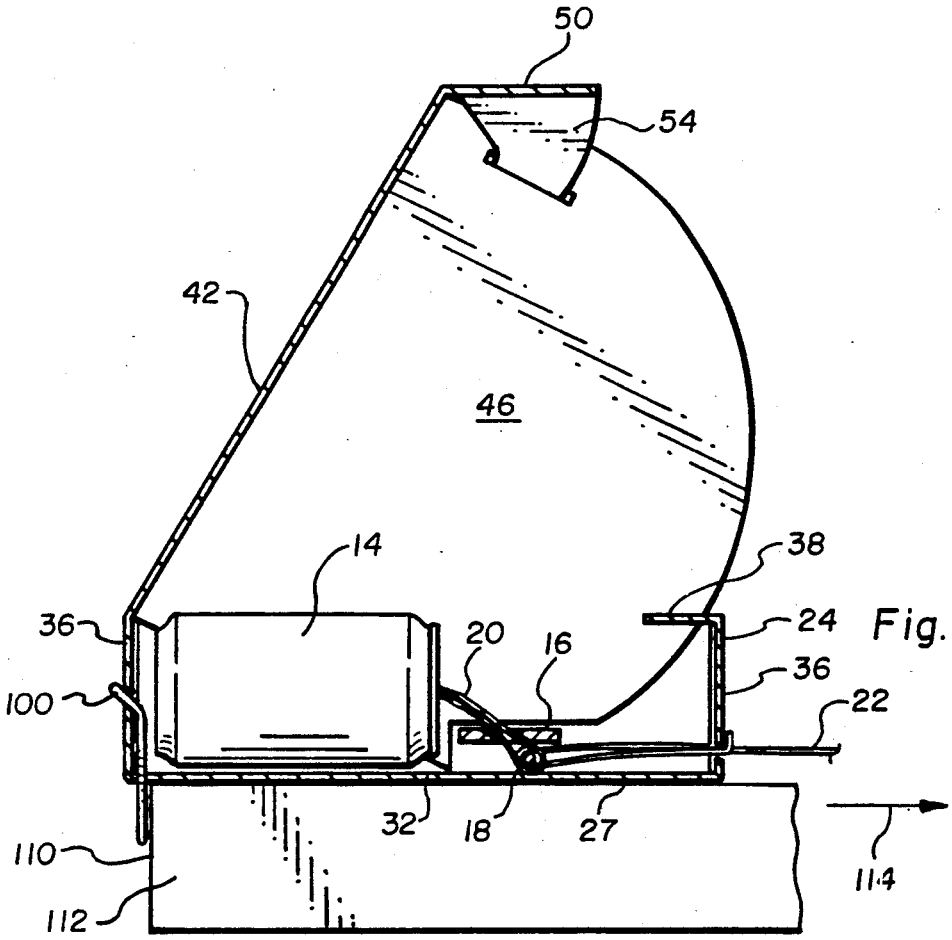
FIG. 3 is a cross-sectional view of the shooting gallery of the invention wherein the target has been knocked down by a force applied thereto by a projectile discharged by the user.
Figure 5:
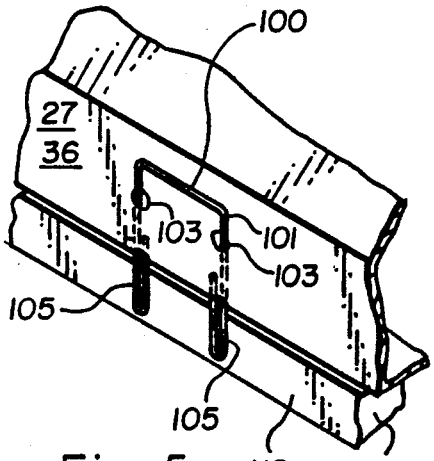
FIG. 5 is a perspective view of the anchoring means of the enclosure of the shooting gallery.

As shown to advantage in FIGS. 3 and 5, the enclosure 12 may be fitted with a restraining means 100 which is adapted to secure the enclosure 12 against a lateral displacement along an underlying surface such as a table.

As shown in FIG. 5, the restraining means 100 may include a generally inverted "U"-shaped member 101 which is slidably received within two pairs of vertically aligned apertures 103 defined within the back sidewall 36 of the box-like configuration 27 of enclosure 12. As shown, this "U"-shaped member includes a pair of legs 105. Each of the legs 105 is directed through a pair of apertures 103 and is thereby adapted to be vertically displaceable upwards as well as downwards. Each leg 105 may be bent along its length backward on itself whereby the outwardly extending ends of each of the legs 105 is formed by two sections of the wire-like material which constitutes the member 101.

The back wall 36 is fabricated of material which is sufficiently resilient to provide some degree of tensioning on the member 101 and thereby retain it in place. In one configuration, as shown in FIG. 3, the bottom-most apertures 103 may, in fact, be configured within the bottom 32 of the box-like configuration 27. As shown in FIG. 5, the box-like configuration 27 may be positioned atop a table 110 proximate the edge 112 thereof. The member 101 is then slidably displaced downwardly such that the ends of each leg 105 are positioned vertically adjacent and in abutment against the table edge 112. As shown in FIG. 3, this positioning of member 101 precludes the box-like enclosure 12 from being displaced on cable 22 in the direction indicated by arrow 114 upon an application of a force directed in the direction of arrow 114. The member 101 thereby prevents the enclosure from being displaced when the user pulls on the cord 22 to reorient the targets 14 in their upright orientation atop the elongate member 16.

Alternative Embodiment

Figure 7:
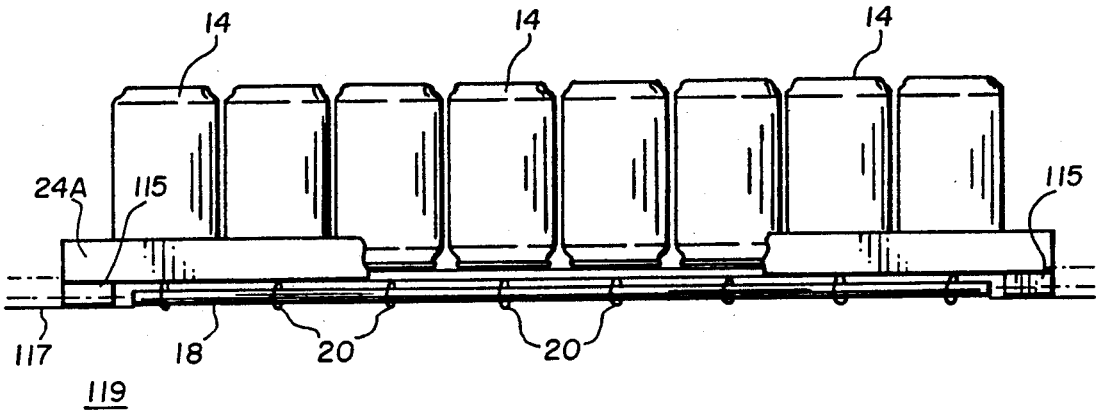
FIG. 7 is a front sectional view of a second embodiment of the invention.

An alternative construction of the instant invention is shown in FIG. 7. As shown therein, the enclosure 12 has been largely eliminated. A pair of support blocks 115 which are spacedly mounted from each other to provide means to support the elongate member 16 thereabove. The support blocks 115 are dimensioned sufficiently to define a space between the bottom surface 68 of the elongate member 16 and the top surface 117 of an underlying surface 119. An upstanding wall 24A, which is formed by a singular planar panel mounted on the support blocks 115, is positioned to function similarly to the upstanding wall 24 of the enclosure 12, i.e. it provides a means of retaining and guiding the targets into an upright orientation on the elongate member 16 upon their return displacement by the rod 18.

As shown in FIG. 2, the operation of the upright wall 24 may be assisted by the flap 38 which may serve to engage and otherwise return a target 14 which has been displaced too far forwardly by the action of the displaced rod 18. With the exception of the configuration of the blocks 115 and the upstanding wall 24A, the operation of the embodiment shown in FIG. 7 is identical to that of the first embodiment shown in FIG. 1.

Operation of the Invention

The shooting gallery shown in FIG. 1 is adapted to place the targets 14 in an orientation suited for the user firing thereupon. Initially, each of the individual targets 14 are placed in an upright orientation atop the elongate member 16 as shown in FIG. 2. As the user fires projectiles at the targets and the targets are struck thereby, the force of the impact of the projectiles causes the individual targets so struck to be knocked downward into a prone position, as shown in FIG. 3. As this occurs, the cable 20, which is dimensioned sufficiently long to permit the knocked down orientation shown in FIG. 3, is displaced outwardly through its respective aperture 72. Preferably, the rod 18 has been positioned in the orientation shown in FIG. 3, and the excess cable has then been stored in the space between the elongate member 16 and the bottom surface 32. As the target is struck and begins its downward displacement, the excess cable is fed through the aperture 72 with no further displacement of the elongate rod 18. Alternatively, should the rod 18 be displaced forwardly of the orientation shown in FIG. 3, the force of the projectile against the target serves to knock the target backward, pulling the cable with it and thereby displacing the rod backward to the orientation shown in FIG. 3.

As the user depletes the number of upstanding targets until there are no remaining targets to be fired upon, he then grasps the cable 22 and pulls it in the direction of arrow 114, as shown in FIG. 3. As the cable is so displaced, the rod 18 is similarly displaced in the direction of arrow 114 thereby displacing with it the cables 20 which are connected to rod 18. As the cables are so displaced, each of the targets 14 are then returned to their upright orientations atop the elongate member 16. During the displacement of cable 22, the member 101, having been displaced vertically downward into abutment against the edge 112 of the table 112 retains the enclosure 12 in position whereby the displacement of the cable 22 operates solely to displace the rod 18.

It is to be understood that the instantly described embodiment is intended solely as a description of a preferred embodiment. Those skilled in the art will recognize that the embodiments herein discussed are illustrative of the general principals of the invention. The embodiments herein described are not intended to limit the scope of the claims which themselves recite what applicant regards as his invention.

What is claimed:

1. A shooting gallery, comprising:

a frame, defining a horizontally oriented support surface, said horizontally oriented support surface defining at least one aperture therethrough;

a target, positioned upright atop said horizontally oriented support surface of said frame, proximate said aperture, said target being displaceable off of said horizontally oriented support surface by a force application thereto;

a cable, having a first end and a second end, said first end being secured to said target, said cable being inserted through said aperture;

a rod positioned below said horizontally oriented support surface, said second end of said cable being secured to said rod, said cable being dimensioned to be displaced through said aperture and to permit said target to be knocked down from its upright position on said support surface by a force application thereto;

wherein a displacement of said rod outwardly away from said frame displaces said cable through said aperture and effects a return of a knocked down target to an upright position atop said horizontally oriented support surface of said frame.

2. The shooting gallery of claim 1, wherein said rod is adapted to be displaced laterally of said frame to effect said return.

3. The shooting gallery of claim 1, wherein said frame includes an elongate member defining a planar support surface upon which said target is set, said elongate member having supports mounted proximate its opening ends to support said elongate member above an underlying surface.

4. The shooting gallery of claim 1, wherein said frame defines a plurality of said apertures in said horizontally oriented support surface along a length thereof.

5. The shooting gallery of claim 1, wherein said cable is fabricated from an elastic, resilient material.

6. The shooting gallery of claim 1, wherein said cable is fabricated from a substantially non-stretchable material.

7. The shooting gallery of claim 1, wherein a longitudinal axis of said frame is aligned parallel with a longitudinal axis of said rod.

8. The shooting gallery of claim 1, wherein a handle is connected to said rod, said handle being graspable by a user to displace said rod.

9. The shooting gallery of claim 1, wherein said handle is a second cable.

10. The shooting gallery of claim 1, wherein said frame includes a vertically upright member configured to extend along said frame to form a stop for said target upon said target's return to its upright position.

11. The shooting gallery of claim 10, wherein a second cable is mounted on said rod, said second cable extending through an opening in said vertically upright member of said frame, said second cable being graspable by a user to displace said rod.

12. The shooting gallery of claim 1, wherein said frame includes an enclosure adapted to receive and retain projectiles directed at said target.

13. The shooting gallery of claim 1, wherein said target is a metal can.

14. The shooting gallery of claim 1, wherein said aperture defines a channel, a longitudinal axis of which is oriented at an obtuse angle to a lateral axis of said horizontally oriented support surface of said frame.

15. The shooting gallery of claim 1, wherein said frame includes a vertically displaceable anchor means adapted to secure said frame from lateral displacement along an underling support surface.

16. The shooting gallery of claim 9, wherein said second cable is fitted with a retaining means adapted to secure and retain a toy gun to facilitate a loading of said toy gun.

17. A shooting gallery, comprising:

an elongate member defining a plurality of channels therethrough positioned spacedly along a length of said elongate member, each channel having a longitudinal axis oriented at an obtuse angle to a lateral axis of said elongate member;

an enclosure, said elongate member being mounted to opposing sidewalls of said enclosure wherein said elongate member is support spacedly above a floor of said enclosure, said enclosure defining an upstanding wall;

a plurality of targets, each target being positioned atop said elongate member proximate a respective said channel;

a plurality of first cables, each said first cable being connected on a first end thereof to a respective said target, each said first cable being inserted through a respective channel;

a rod, positioned below said elongate member, each said first cable being connected to said rod on a second end of each said first cable;

a second cable, connected to said rod, said second cable passing through an aperture in said upstanding wall of said enclosure, said second cable being graspable by a user to displace said rod laterally of said elongate member;

wherein each said target may be knocked down from its upright position by a force application thereto, a subsequent lateral displacement of said rod outwardly away from said frame, by means of a displacement of said second cable, effecting a return of said target to its said upright position atop said frame.

18. The shooting gallery of claim 17, wherein said cable is fabricated from an elastic, resilient material.

19. The shooting gallery of claim 17, wherein said cable is fabricated from a substantially non-stretchable material.

20. The shooting gallery of claim 17, wherein a longitudinal axis of said frame is aligned parallel with a longitudinal axis of said rod.

* * * * *